US005566770A

United States Patent [19]

Bowser

[11] Patent Number: 5,566,770

[45] Date of Patent: Oct. 22, 1996

[54] GEARLESS ANGLED SPINDLE

[75] Inventor: Gregory A. Bowser, Boynton Beach, Fla.

[73] Assignee: Air Turbine Technology, Inc., Boca Raton, Fla.

[21] Appl. No.: 320,980

[22] Filed: Oct. 11, 1994

Related U.S. Application Data

[63] Continuation of Ser. No. 112,390, Aug. 27, 1993, abandoned.

[51] Int. Cl.[6] ..... F03B 13/00

[52] U.S. Cl. ..... 173/218; 173/213

[58] Field of Search ..... 173/218, 213, 173/221, 168, 169, 170; 30/272.1, 277.1

[56] References Cited

U.S. PATENT DOCUMENTS

| | | | |
|---|---|---|---|
| 3,120,705 | 2/1964 | Hoffmeister et al. . | |
| 3,306,375 | 2/1967 | Macks | 173/218 X |
| 3,832,772 | 9/1974 | Sumida | 30/277.4 X |
| 4,185,386 | 1/1980 | Nordin et al. . | |
| 4,281,989 | 8/1981 | Glover et al. . | |
| 4,303,393 | 12/1981 | Gentry . | |
| 4,380,270 | 4/1983 | Ludwig | 173/221 |
| 4,776,752 | 10/1988 | Davis . | |

OTHER PUBLICATIONS

The Illustrated Science And Invention Encyclopedia, vol. 13, pp. 1798–1799.

The Illustrated Science And Invention Encyclopedia, vol. 6, p. 802.

Compressed Air And Gas Handbook, John P. Rollins, Editor, Fifth Edition, Prentice Hall, 1989, pp. 266–279.

Dynabrade Catalog, "Industrial Abrasive Power Tools", 1993, Front and Back Cover Pages and pp. 50–59.

*Primary Examiner*—Eugenia Jones
*Assistant Examiner*—Boyer D. Ashley
*Attorney, Agent, or Firm*—Curtis, Morris & Safford

[57] ABSTRACT

A spindle apparatus operative by a fluid powered reaction turbine-type motor and having a handle portion, a head portion and a device for attaching a desired tool thereto. The handle portion includes a channel for directing the flow of a received fluid. The head portion includes the reaction turbine-type motor which is coupled to an outlet of the channel so as to receive the fluid therefrom. The head portion further includes a rotatable shaft which is coupled to the reaction turbine-type motor and to the attaching device. Upon receiving fluid from the handle portion, the reaction turbine-type motor rotates, thereby causing the shaft and the tool to rotate.

10 Claims, 3 Drawing Sheets

GEARLESS ANGLED SPINDLE

This application is a continuation of U.S. patent application Ser. No. 08/112,390, filed Aug. 27, 1993, now abandoned.

BACKGROUND OF THE INVENTION

1. Field of the Invention

This invention relates to a spindle apparatus and, more particularly, to a spindle apparatus operative by a fluid powered turbine (reaction) and having a handle portion and a head portion which are coupled to each other without using gears.

2. Description of the Prior Art

In the prior art, spindle devices may be utilized for performing a variety of functions, such as grinding, polishing, metal or plastic finishing, engraving, jewelry fabrication, drilling, deburring and so forth. These spindle devices normally include a handle portion having a primary rotatable shaft and a head or front end portion having a secondary rotatable shaft. The head portion of such devices may be arranged at a predetermined angle with respect to the handle portion. Accordingly, in these spindle devices, the axes of rotation of the primary and secondary axes are typically not parallel to each other. Such angled positioning of the head portion enables an operator to more easily reach a desired object.

Such prior art spindle devices normally utilize a so-called vane-type fluid motor which may be located in the handle portion and which is coupled to the primary shaft therein. The primary shaft, in turn, is coupled to the secondary shaft by way of a gear train having a plurality of gears.

The vane-type motor may be considered as a type of impulse turbine. Basically, in the vane-type motor, a fluid is directed in a stream or streams towards an outer periphery of a rotatable impeller or vane. The vane is coupled to a rotatable shaft which, in turn, is coupled to a rotatable tool, such as a grinder, a drill and so forth. The rotational speed of the vane, and the tool, is a function of fluid flow and the pressure of such fluid. Accordingly, the vane-type motor act as a "free speed motor".

In operation, a fluid, such as air, is supplied to the handle portion from an air supply, whereupon the fluid is directed to an input of the vane-type motor and from there to the outer periphery of the vane. As a result, the vane rotates causing the primary shaft to rotate which causes the gears to rotate which, in turn, causes the secondary shaft to rotate, thereby causing the grinding or finishing tool or such similar tool to rotate.

The vane-type fluid motors are relatively heavy and noisy. In addition, rotation of the gears produces relatively high vibration levels. Such undesirable characteristics may result in the operator becoming fatigued after using such device for only a relatively short period of time. As is to be appreciated, this may result in less productivity and/or poor workmanship.

Further, the gears normally require lubrication so as to operate properly and to increase the operating life of the gears. However, providing such lubrication is time consuming and increases the overall operating costs. Moreover, even with such periodic lubrication, the gears still wear and accordingly require maintenance and/or replacement.

Furthermore, vane-type motors are normally unable to maintain a constant rotational speed when operating under a load. That is, the vane-type motors can not be governed to a specific speed. Additionally, as previously described, vane-type motors are "free speed" motors and are sensitive to variations in flow and pressure. Accordingly, it may be difficult to maintain a tool coupled to a vane-type motor at a constant speed especially when subjected to varying loads. As is to be appreciated, the inability to maintain a constant rotational speed of a tool may adversely affect a desired operation. For example, an undesired sudden increase in the rotational speed of a grinding or drilling tool may result in more material being removed than desired.

Other conventional spindle devices, such as that described in U.S. Pat. No. 3,120,705, are utilized for dental purposes. In these spindle devices, an impulse turbine is located in the head portion of the spindle. As a result, the head portion in these devices is coupled to the handle portion without the use of gears or the like. The handle portion in these devices, unlike that in the previously described devices, does not include a primary shaft and instead includes additional channeling or tubing for directing the flow of received fluids therethrough. In addition to the impulse turbine, the head portion includes channeling or tubing and a shaft coupled to the motor. In operation, a fluid, such as air, is supplied through the channeling in the handle portion to an inlet of the channeling in the head portion and therefrom to an input of the impulse turbine, whereupon the fluid is directed through a nozzle to the outer periphery of the turbine rotor. As a result, the vane rotates causing the shaft to rotate which, in turn, causes a grinding-type tool to rotate.

An impulse turbine can be relatively heavy. By placing the relatively heavy impulse turbine in the head portion, the balance of the spindle device may be adversely affected, thereby making the use of such device difficult or cumbersome. Thus, the spindle devices having as impulse turbine located in the head portion may still be difficult to operate and when combined with the relatively high noise level produced by such motor as previously described, may cause operator fatigue.

Further, by using an impulse turbine, the spindle of the type in which the turbine is located in the head portion thereof, like the spindle having the motor located in the handle portion, is unable to maintain a constant rotational speed of the tool when subjected to varying loads.

Thus, the prior art has failed to provide a spindle which is relatively light weight, produces only a relatively low noise level and vibration level when operating, and maintains a constant rotational speed when subjected to a load.

OBJECTS AND SUMMARY OF THE INVENTION

An object of the present invention is to provide a spindle apparatus which overcomes the problems associated with the prior art.

More specifically, it is an object of the present invention to provide a spindle apparatus which is able to maintain a constant rotational speed when subjected to a load.

Another object of the present invention is to provide a spindle apparatus as aforementioned which produces only a relatively low noise level and vibration levels when operating.

It is still another object of the present invention to provide a spindle apparatus as aforementioned which is relatively light weight.

In accordance with an aspect of this invention, a spindle apparatus is provided which comprises a handle portion having means for directing the flow of a received fluid therethrough; a head portion having a reaction turbine-type motor coupled to an outlet of the directing means for receiving the fluid therefrom and a rotatable shaft coupled to the reaction turbine-type motor; and means for attaching a desired tool to the rotatable shaft. The reaction turbine-type motor causes the shaft and the tool to rotate upon receiving the fluid from the outlet of the directing means.

Other objects, features and advantages according to the present invention will become apparent from the following detailed description of the illustrated embodiments when read in conjunction with the accompanying drawings in which corresponding components are identified by the same reference numerals.

DETAILED DESCRIPTION OF THE PREFERRED EMBODIMENT

Figure 1:
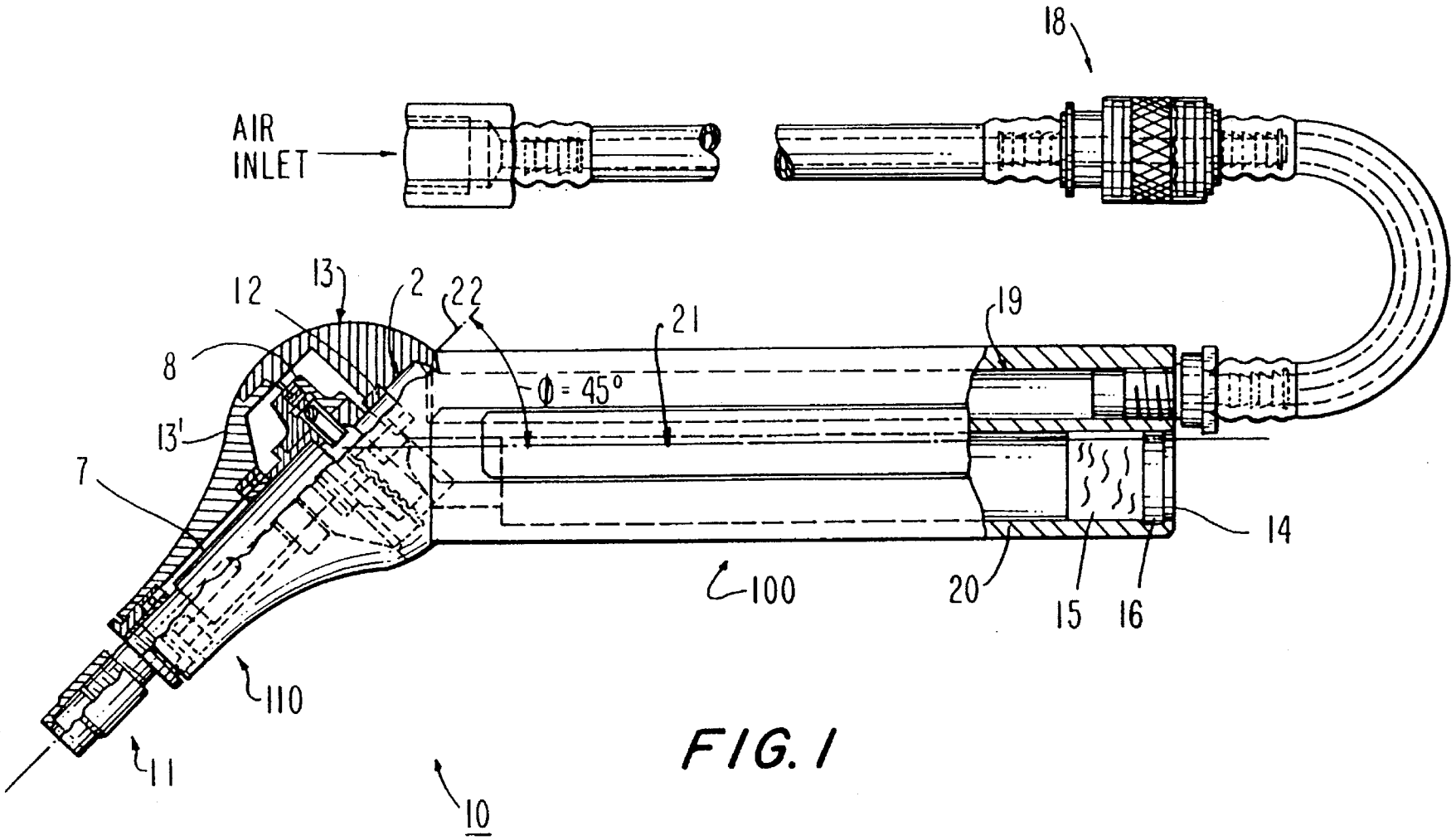
FIG. 1 illustrates a spindle apparatus according to an embodiment of the present invention in which a head portion thereof is arranged in first position.
Figure 2:
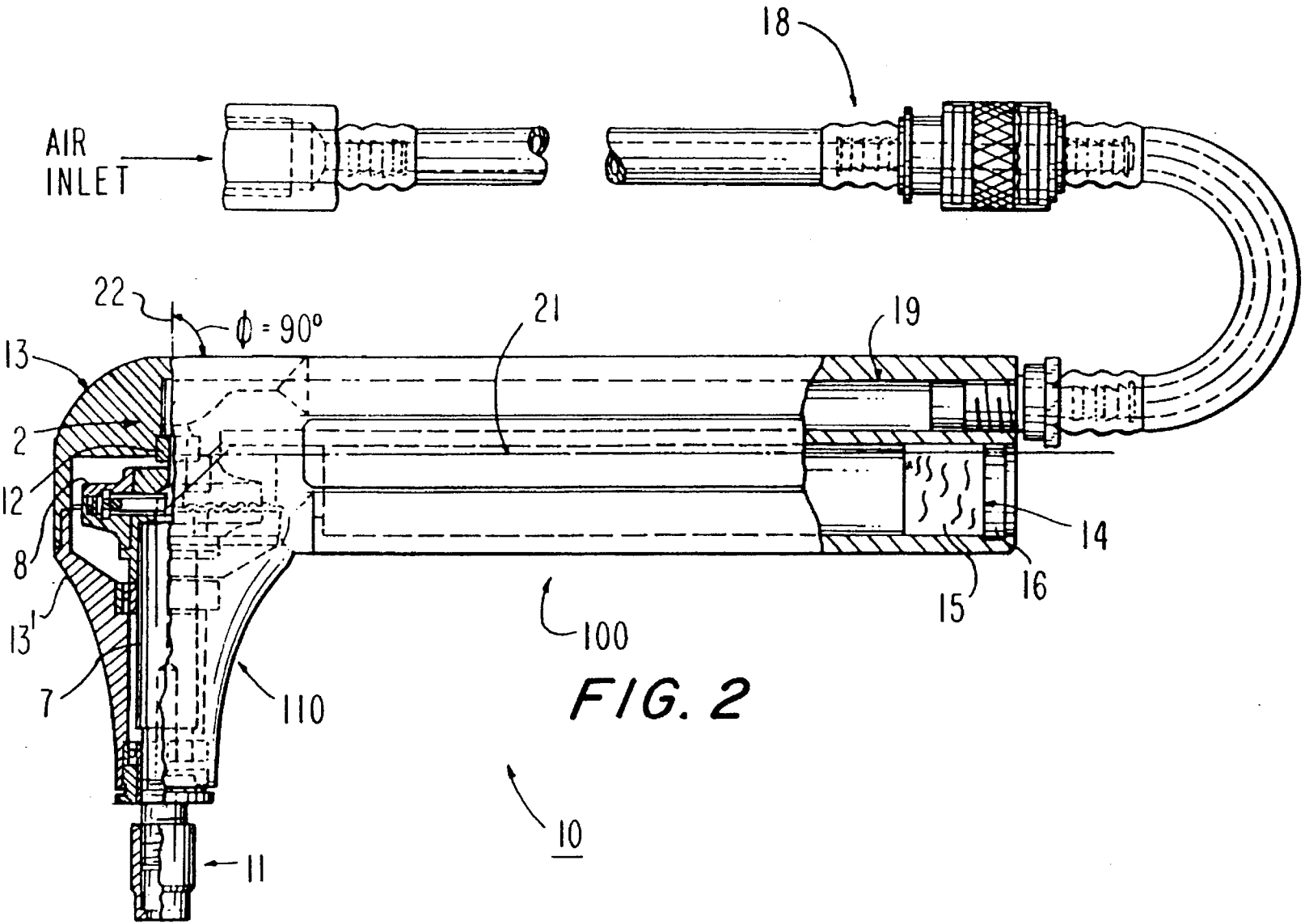
FIG. 2 illustrates the spindle apparatus of FIG. 1 in which the head portion is arranged in a second position.

FIGS. 1 and 2 illustrates a spindle apparatus 10 according to an embodiment of the present invention. As shown therein, the spindle apparatus 10 generally comprises a handle portion 100 and a front end or head portion 110.

The handle portion 100 includes a channel 19 which is adapted to receive a fluid from a fluid supply (not shown) and to direct the flow of the fluid through the handle portion to an outlet in a housing 13 which is adjacent to the head portion 110. The handle portion further includes a channel or duct 20 which receives returned or exhausted fluid from the head portion for supply from the spindle apparatus. The handle portion still further includes a muffler pad, which may be composed of a felt-like material, and a muffler screen 14, which may be composed of a stainless steel. The muffler screen 14 and the muffler pad 15, which are secured in place by use of a muffler screen retaining nut 16, are respectively adapted for screening the exhausted fluid and for muffling the noise caused by such fluid.

The head portion 110 generally includes a housing 13', which is coupled to housing 13 and, which may be fabricated from steel, aluminum, plastic or similar such material; a reaction turbine-type motor 8; a shaft 7, which may be formed from hardened or non-hardened steel, aluminum or composite materials; and an attaching device 11.

The reaction turbine-type motor preferably is of the type described in U.S. Pat. No. 4,776,752 to Davis, which has a common assignee with the present invention and the disclosure of which is hereby incorporated by reference. Such reaction turbine-type motor 8 as in the Davis patent is actuated by pressurized fluid and is capable of relatively precise speed control and is also capable of fully shutting off the pressurized fluid if for any reason a desired speed is exceeded. Such motor has a relatively small size and has a relatively light weight, but nevertheless is able to provide a relatively high torque.

Figure 3:
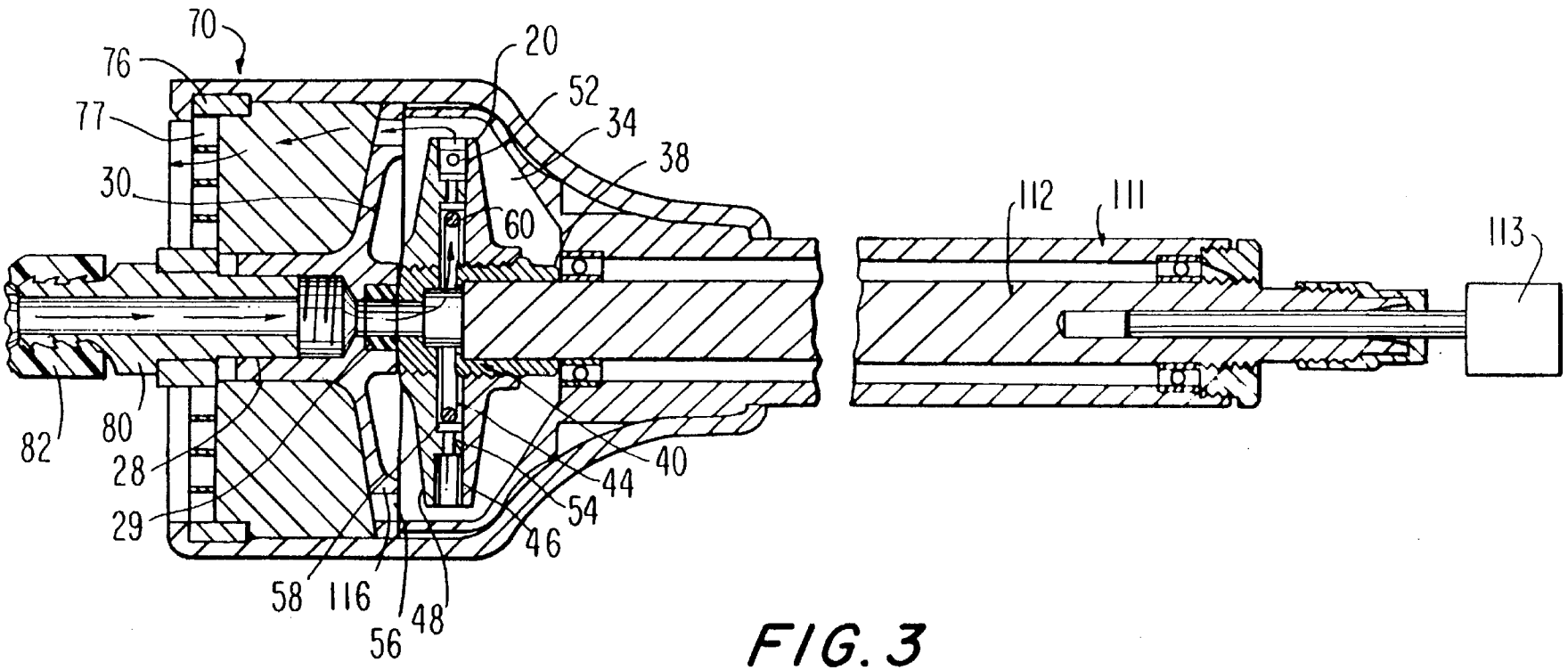
FIG. 3 PRIOR ART
FIG. 3 illustrates a cross-sectional side view of a reaction turbine-type motor used in the spindle apparatus of FIGS. 1 and 2.

As described in one preferred embodiment for a reaction turbine-type motor in accordance with the Davis patent and as illustrated in FIG. 3 herein, such motor generally comprises: an elongated forward housing 111; a rearward housing 116; a rotatable drive shaft means 112; and a turbine rotor 20. In operation, a pressurized fluid flow is directed into an inlet adapter 80 from a flexible hose 82, through inlet adapter 80, connected cylindrical pressurized fluid inlet portion 28, and sealing ring 29 into a third counterbore at the rear of a turbine rotor coupler 38. The flow then goes radially outwardly from a second midpoint counterbore portion of the turbine rotor coupler 38 through diametrically opposed radial openings 40. Here the pressurized flow passes out of a first annular chamber 44 around resilient value ring 60 and through grooves 58 to radial holes 54 into a second annular chamber 46 where it is directed through nozzles 52, thereby imparting rotation to a rotatable drive shaft means 112 and grinding wheel 113. The pressurized fluid then passes into cylindrical chamber 34 where it exits through exit opening 56, in outwardly extending flange portion 30 of rearward housing 116, into the muffling housing 70 where the exhaust nozzle is muffled, and the exhausted flow then exits through openings 77 through the rear holding plate 76 to atmosphere. As a pressurized fluid, such as compressed air, is directed into inlet adapter 80 at a selected p.s.i., rotation increases to a preselected maximum; centrifugal forces acting on resilient valve ring 60 tend to cause radial expansion of said ring 60. However, the inner surface of the annular wall 48 supports valve ring 60, except at grooves 58. This enables the radial expansion of the valve ring 60 to be directed into the grooves 58 so as to cause a controlled elastic deformation of valve ring 60. By this construction, flow can be essentially unrestricted until valve ring 60 comes into relatively close proximity to radial holes 54. By this construction, forces acting on the elastic material are of sufficient magnitude as to cause pressure differential between radial holes 54 and the first annular chamber 44 to be relatively insignificant to operation, allowing smooth operation. In operation, as the resilient valve ring 60 deforms, it approaches the ends of radial holes 54. As the distance narrows sufficiently, fluid flow through the radial holes 54 is restricted and rotating forces reduced. As drag forces acting on the system and rotating forces reach equilibrium, the forces acting on the resilient valve ring 60, namely centrifugal forces, centripetal forces, pressure differential forces across the ring, and the resilient forces acting to return the elastic material to its original configuration, will also be in equilibrium. This results in a constant rotary speed. If drag forces increase, the equilibrium would be disrupted, and the resilient valve ring 60 resilient forces will retract the valve ring 60 from its closest proximity to radial holes 54, allowing additional fluid flow until another equilibrium is established. If for any reason the turbine should exceed the desired governed speed, the resilient valve ring 60 will move to restrict pressure fluid flow even further until sufficient overspeed will cause all flow to stop, thereby incorporating an overspeed safety.

Referring back to FIG. 1, the reaction turbine-type motor 8 is secured inside the housing 13 and arranged therein so as to receive fluid from an outlet of the channel 19. To facilitate such receipt of fluid by the motor 8, channeling or ducts 2 may be utilized between the motor and the outlet of the channel 19. Further, a seal 12, which may be fabricated from a nylon-like material, is provided at the portion of the motor which receives the fluid so as to ensure a proper sealing arrangement. The motor 8 is securely coupled to the shaft 7 which, in turn, is securely coupled to the attaching device 11.

The attaching device 11 is adapted to have a desired tool, such as a grinder, a drill and so forth, be attached thereto. Such attachment is relatively easy and is normally performed by the operator.

In operation, a fluid, such as compressed air, is supplied from an air supply or tank (not shown) through a coupling arrangement 18, which may include appropriate fittings and rigid and/or a flexible hose or tubing or the like, to an inlet of the channel 19. Upon reaching the channel 19, the air is directed or flows to an outlet of the channel 19, whereupon the air is supplied through an inlet of the channel 2 and then there through to an inlet of the motor 8. Once at the motor 8, the air is directed as previously described so as to cause the shaft 7 and the tool coupled to the attaching device 11 to rotate. The exhausted air is supplied through the channel 20, the muffler 15 and the screen 16 to the outside of the spindle apparatus 10.

In the preferred embodiment of the present invention, the head portion 110 is arranged at a fixed predetermined angle 22 with respect to the handle portion 100, such as illustrated in either of FIGS. 1 and 2. More specifically, the head portion is arranged such that an axis of rotation of the shaft 7, which is preferably also the axis of rotation of the motor 8, forms an angle $\phi$ with respect to a longitudinal axis 21 of the handle portion 100. Although in the preferred embodiment, the spindle apparatus has an angle $\phi$ which lies within the range of ±90 degrees, the present invention is not so limited. That is, the angle $\phi$ may have a value lying outside this preferred range.

Further, although, in the preferred embodiment of the present invention, the head portion 110 is fixedly arranged so as to have a predetermined angle $\phi$ with respect to the handle portion 100 as previously described, the present invention is not so limited. For example, the head portion 110 may be rotatably coupled to the handle portion 100 so to allow the head portion to be rotated to a desired angle $\phi$ and, upon reaching the desired angle, the head portion is secured or locked in place.

The spindle apparatus 10, like the conventional spindle devices previously discussed, may be used for performing a variety of tasks, such as grinding, polishing, metal or plastic finishing, engraving, jewelry fabrication, drilling deburring and so forth. Since the head portion 110 may be arranged at a desired angle with respect to the handle portion 100 and since the attaching device 11 can accommodate numerous different types of tools, as previously described, the spindle apparatus 10 may be used for performing a relatively large variety of tasks, some of which may not be possible with a conventional type spindle, such as a strait spindle.

Furthermore, although in the preferred embodiment compressed air is used as the fluid, the present invention is not so limited. That is, other fluids, such as water, may also be utilized.

Thus, in the spindle apparatus 10, the head portion 110 is coupled to the handle potion 100 without using any gears or similar such devices. Accordingly, the disadvantages associated with the use of gears in spindles, such as those previously described, are eliminated. Further, by utilizing a reaction turbine-type motor and by placing the same in the head portion of a spindle apparatus, the present invention provides a spindle apparatus which is capable of relatively precise speed control, produces only a relatively low noise level and vibration levels during operation, and is relatively light weight.

Although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. A spindle apparatus comprising:

a handle portion having a longitudinal axis, said handle portion including means for receiving air and for directing the flow of said air therethrough;

a head portion having a reaction turbine-type motor coupled to an outlet of the directing means for receiving said air therefrom and a rotatable shaft coupled to said reaction turbine-type motor, said rotatable shaft having an axis of rotation, said head portion being coupled to said handle portion such that said axis of rotation forms a predetermined angle with respect to said longitudinal axis; and means for attaching a desired tool to said rotatable shaft;

said reaction turbine-type motor causing said shaft and said tool to rotate upon receiving said air from said outlet of said directing means.

2. The spindle apparatus according to claim 1, wherein said predetermined angle has a value of approximately 45 degrees.

3. The spindle apparatus according to claim 1, wherein said predetermined angle has a value of approximately 90 degrees.

4. A spindle apparatus comprising:

a handle portion having a longitudinal axis, said handle portion including channel means for receiving air and for directing the flow of the received air therethrough;

a head portion coupled to said handle portion without the use of any gears and having a rotatable shaft and a reaction turbine-type motor for receiving said air from an outlet of said channel means and, in response thereto, for causing said shaft to rotate about an axis of rotation, said head portion being coupled to said handle portion such that said axis of rotation forms a predetermined angle with respect to said longitudinal axis; and means for attaching a desired tool to said rotatable shaft.

5. The spindle apparatus according to claim 4, wherein said predetermined angle has a value of approximately 45 degrees.

6. The spindle apparatus according to claim 4, wherein said predetermined angle has a value of approximately 90 degrees.

7. A spindle apparatus comprising:

a handle portion having a longitudinal axis and including channel means for receiving a fluid and for directing the flow of the received fluid therethrough;

a head portion having a reaction turbine-type motor coupled to an outlet of said channel means for receiving said fluid therefrom and a rotatable shaft with an axis of rotation, said head portion being coupled to said handle portion such that the longitudinal axis of said handle portion and said axis of rotation of said shaft are non-parallel to each other; and means for attaching a desired tool to said rotatable shaft;

said reaction turbine-type motor causing said shaft and said tool to rotate upon receiving said fluid from said outlet of said channel means.

8. The spindle apparatus according to claim 7, wherein said fluid is air.

9. The spindle apparatus according to claim 8, wherein an angle formed between said longitudinal axis of said handle portion and said axis of rotation of said shaft has a value of approximately 45 degrees.

10. The spindle apparatus according to claim 8, wherein an angle formed between said longitudinal axis of said handle portion and said axis of rotation of said shaft has a value of approximately 90 degrees.

* * * * *